US005367997A

United States Patent [19]

Kawamura et al.

[11] Patent Number: 5,367,997

[45] Date of Patent: Nov. 29, 1994

[54] THROTTLE ACTUATOR

[75] Inventors: Masahiro Kawamura, Takatsuki; Masuo Takigawa, Ikoma; Yasuhiro Kondou, Hirakata; Tutomu Hamada, Hirakata; Teruo Maruyama, Hirakata; Akio Masuo, Ohtsu, all of Japan

[73] Assignee: Matsushita Industrial Co., Ltd., Kadoma, Japan

[21] Appl. No.: 123,384

[22] Filed: Aug. 18, 1993

Related U.S. Application Data

[63] Continuation of Ser. No. 13,384, Feb. 4, 1993, abandoned.

[30] Foreign Application Priority Data

Feb. 10, 1992 [JP] Japan ..... 4-023505
Mar. 10, 1992 [JP] Japan ..... 4-051110

[51] Int. Cl.[5] ..... F02D 9/10; F02D 11/10
[52] U.S. Cl. ..... 123/399; 123/400
[58] Field of Search ..... 123/337, 361, 399, 400; 74/500.5, 504

[56] References Cited

U.S. PATENT DOCUMENTS 4,860,708 8/1989 Yamaguchi et al. ..... 123/399
4,879,657 11/1989 Tamura et al. ..... 123/399
4,895,343 1/1990 Sato ..... 251/129.03
5,014,666 5/1991 Westenberger ..... 123/399 X
5,040,508 8/1991 Watanabe ..... 123/399 X
5,161,507 11/1992 Terazawa et al. ..... 123/399
5,163,402 11/1992 Taguchi et al. ..... 123/399 X
5,178,112 1/1993 Terazawa et al. ..... 123/399

FOREIGN PATENT DOCUMENTS 0377875 7/1990 European Pat. Off. .
0413082 2/1991 European Pat. Off. .
2599805 12/1987 France .

*Primary Examiner*—Willis R. Wolfe
*Attorney, Agent, or Firm*—Beveridge, DeGrandi, Weilacher & Young

[57] ABSTRACT

A first link member (7), an upper-limit link member (9*a*), and a lower-limit link member (9*b*) are rotatably and axially coupled together. When the throttle is to be opened, the throttle valve (5) is electrically controlled by the motor (4) which has been under the control of an output from the accelerator opening sensing device (3), and at the same time, the throttle valve (5) is mechanically controlled by the wire (12) through the link members (7, 9*a*, 9*b*) in response to the degree of opening of the accelerator. A high degree of throttle operation such as traction control, idling control, constant speed run, etc. can be executed normally, and when an abnormality arises, the fail-safe function is at work to close the throttle valve (5).

20 Claims, 16 Drawing Sheets

THROTTLE ACTUATOR

This application is a continuation of application Ser. No. 08/013,384, filed Feb. 4, 1993, which application is now abandoned.

BACKGROUND OF THE INVENTION

1. Field of the Invention

The present invention relates to a throttle actuator for controllably moving the throttle of an automobile and the like between open and closing positions, and in particular to a throttle actuator which is under the control of both electric motor and wire.

2. Related Art of the Invention

Recently, automobiles have converted from means just intended for running from one place to another into means that rides easily or more comfortable vehicles. With the advent of such a need, various sorts of cruising systems are now being considered based on higher control technologies such as 4 wheel drive, 4 wheel steering, cruise control, etc. Among them, there is an attempt of obtaining cruising stability and safety, as well as low cost of fuel by the control of the throttle valve acting as a feed opening for fuel.

In a conventional car engine, the opening of degree of the throttle had only to act in response to the depression amount of an accelerator when it is pressed down. In this respect, the throttle valve and accelerator were mechanically connected with each other by means of a wire or link. As mentioned above, however, in many cases the throttle is now arranged such that it is electronically controlled for its opening dependent on the cruising conditions of the automobiles. Such an electronic control method has assisted developing of a cruise control function of keeping the running speed constant by regulating the output of an engine, TCS (traction control system) of preventing slipping of drive wheels by reducing the output of the engine, and ISC (Idle speed control) of controlling the rotational speed of the engine when idling takes place.

However, a variety of problems may result from attempts to bring the throttle under electronic control. The reason is as follows. There are different forms of approach to the electronic control of the throttle.

Specifically, it is an wholly electronically operable actuator that can make a control of the throttle. In this system, a throttle and an accelerator are quite independent from each other in mechanical terms with the structure that the depression amount of the accelerator may be read out by a sensor so as to drive the valve by a motor.

Another typical approach has an additional electronic control function with the mechanical connections reserved for operating the throttle valve by the use of the accelerator.

In comparison of the both above-described approaches, the former has an advantage that a small number of parts can do, that any mechanical connection is unnecessary, and that a single actuator can do, while the latter requires the mechanical connection and one (or two) actuator(s) as well.

In contrast, however, the former has a fault that it costs expensive. For example, provided only a cruise control is equipped as an optional function, an actuator such as an expensive stepping motor must indispensably be added in order to satisfy the cruise control function only, thus resulting in no substantial difference cost either if only one function is used or another function such as TCS is added to the function. With reference to the safety (fail-safe function) as a most important element, it is very difficult to secure the safety in the former system. Such being the case, it is considered to be unrisky that the mechanical system that has been used long with actual achievements in reliability is reserved.

Even so the latter, namely, the coexistence of mechanics and electronics tends to cause a complication in mechanism. FIG. 8 shows the conventional throttle valve having two valves provided within the body thereof. As shown in FIG. 8, this conventional example has a structure that one valve 80 is mechanically actuated by the accelerator and the other valve 82 is electronically controlled using a stepping motor 84, via a pinion 86 and a cam gear 88.

For example as the mechanics and electronics, another prior art is disclosed in Japan laid-open patent application No.64-12038. FIG. 7 shows this prior art. As shown in this drawing, if an accelerator 71 is depressed in the direction of an arrow A, a link member 73 is turned in the direction of an arrow B through a wire 72, and a throttle valve 75 is opened in the direction of an arrow C through a spring 74. With this state maintained, for an attempt to narrow the opening of the throttle valve 75 a little closer, the motor 76 is driven so as to be rotated by the shaft thereof in a direction D, and the link member 78 will be rotated through a connecting rod 77 in a direction E so that the throttle valve 75 may be closed by the spring 74 which is being compressed.

In the first prior art of FIG. 8, however, the throttle as a whole is inevitably of a large and heavy type due to its structure of two valves. The second prior art of FIG. 7 has a throttle that needs to transmit exact information of the degree of opening of the accelerator 71 generally during cruising, thus necessarily setting the spring 74 of an essentially strong resiliency. In this strong spring 74, if the throttle is to be actuated by the motor 76 to reduce speed, the spring 74 subjected to strong setting will have to be brought to more compression, with the result that a motor of a large type with a high torque is required. Additionally, since other specific mechanism is required to reduce the torque of the motor, the device will be of a mechanically bulky and complicated type.

SUMMARY OF THE INVENTION

The present invention is intended to solve the above-described tasks, and has an object of providing a throttle actuator which is light in weight, compact in size, and easy to mount though it has an electro-mechanical construction, or provided with a fail-safe mechanism.

The throttle actuator of the present invention comprises: an intake pipe of feeding vaporized fuel to an engine, a throttle valve arranged in the intake pipe and adapted to rotatably be driven to open and closed positions, a throttle valve shaft supporting the throttle valve and rotatably mounted on a portion of a vehicle, a motor for supplying a torque to the throttle valve shaft, a first link member secured to and transmitting a torque to the throttle valve shaft, a second link member having two stopper parts engageable with the first link member and movable in response to an accelerator depression amount, a motor control means for controlling the motor, an accelerator returning means of always supplying a torque to the throttle valve shaft so as to close the throttle valve, and the first link member being coupled to the second link member in a manner that the first link member is allowed to rotate between the two stopper parts, and the motor control means driving the motor to control the throttle valve shaft so as to make the first link member rotate between the two stopper parts.

In accordance with the described structure, the first aspect of the invention may use a throttle actuator of a compact and light weight type because it may have a single motor, and the load of the motor has only to overcome a throttle return spring having a light load. In the event of a throttle failure, the second link member connected with the accelerator is capable of mechanically driving the first link member, so that the fail-safe function can be achieved.

With reference to the second aspect of the invention, as the additional working elements relative to the first aspect of the invention, the stator of the motor is rotatable, and the rotor can be rotated by an identical amount of rotation to that of the second link member by means of the wire connected with the accelerator, and therefore, if the rotor and stator of the motor are locked because of dust deposited thereon, the fail-safe function can be achieved.

In accordance with a third aspect of the invention, a mere change of the relation between a slot and a pin provided in first and second link members of the first aspect of the invention enables the throttle to open by means of the motor to the extent of the slot provided in the first link member relative to the opening of the accelerator. This specific operation realizes a high degree of control as performed in the cruise control, TCS, ISC, etc., providing a vehicle of an increased reliability, a comfort, and a high performance.

In accordance with a fourth aspect of the invention, since the provision of the second link member constituted by two members for upper and lower limitations allows an arbitrary setting of the tolerance of rotation, a variety of requests can be met in the fail-safe operation.

BRIEF DESCRIPTION OF THE DRAWINGS

FIGS. 13*a* and *b* are views illustrating a rotation tolerance obtainable by the structure of FIG. 12 and so on.

DESCRIPTION OF THE PREFERRED EMBODIMENTS

(First Embodiment)

Figure 1:
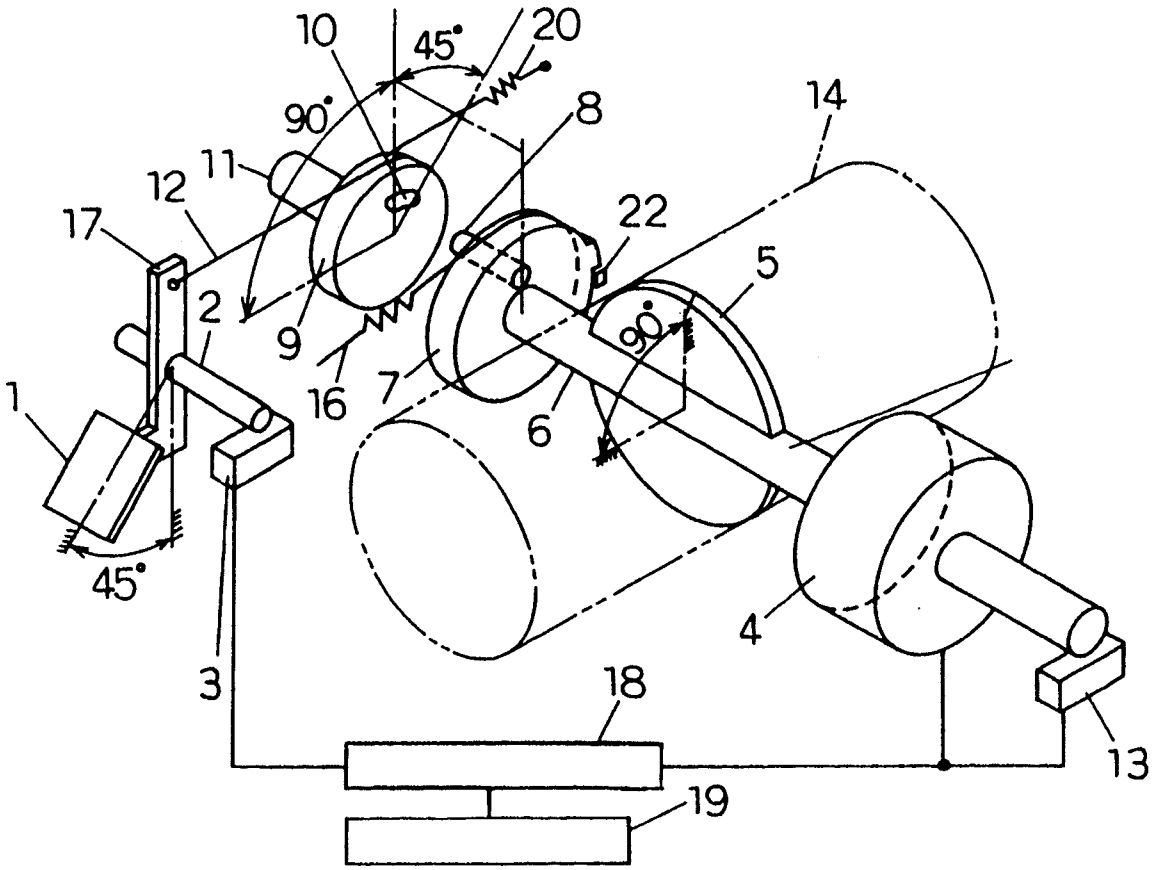
FIG. 1 is a perspective view showing the first embodiment structure of the throttle actuator in accordance with the present invention.

Now, the embodiments of the present invention is described with reference to the drawings. FIG. 1 is a view of a first embodiment of the present invention. In the drawing, the numeral 1 designates an accelerator pedal, 2 an accelerator rotating shaft acting as means for transmitting a rotary motion originated from the accelerator pedal 1. An arrow labelled 45° near the pedal 1 in FIG. 1 indicates the movement of the accelerator pedal 1, wherein when the pedal is at the left side position, the pedal is in the "closed" position, and when the pedal is at the right side position, it is in the "open" position. 3 is an accelerator opening sensing device for detecting the rotation angle of the accelerator rotating shaft 2, which sensing device is, in the embodiment, a magnetic sensor adapted to detect magnetic spots marked on the accelerator rotating shaft 2 as an encoder. The sensing device 3 requires a high accuracy, preferably of a non-contact type. Such a non-contact sensor involves an optical sensor which may also be used. A potentiometer may be used, too, if it is of a contact type.

The numeral 4 identifies a motor for electrically opening or closing a throttle valve, which motor is constituted by a stepping motor in this embodiment. The case of a stator of the motor 4 is fixed to a main body (not shown). The stepping motor used in this embodiment is a product by Matsushita Electric Co., Ltd., with a model No. 39SHM-32B. The specification of this motor is as follows.

Figure 6:
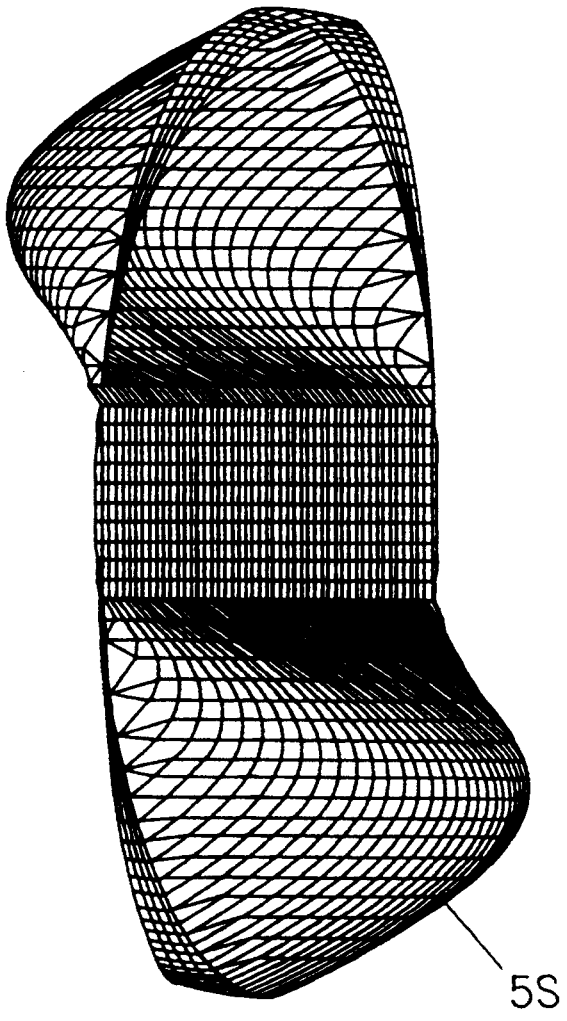
FIG. 6 is a view showing by way of example S-shaped valve for use in the embodiment of the present invention.
Figure 7:
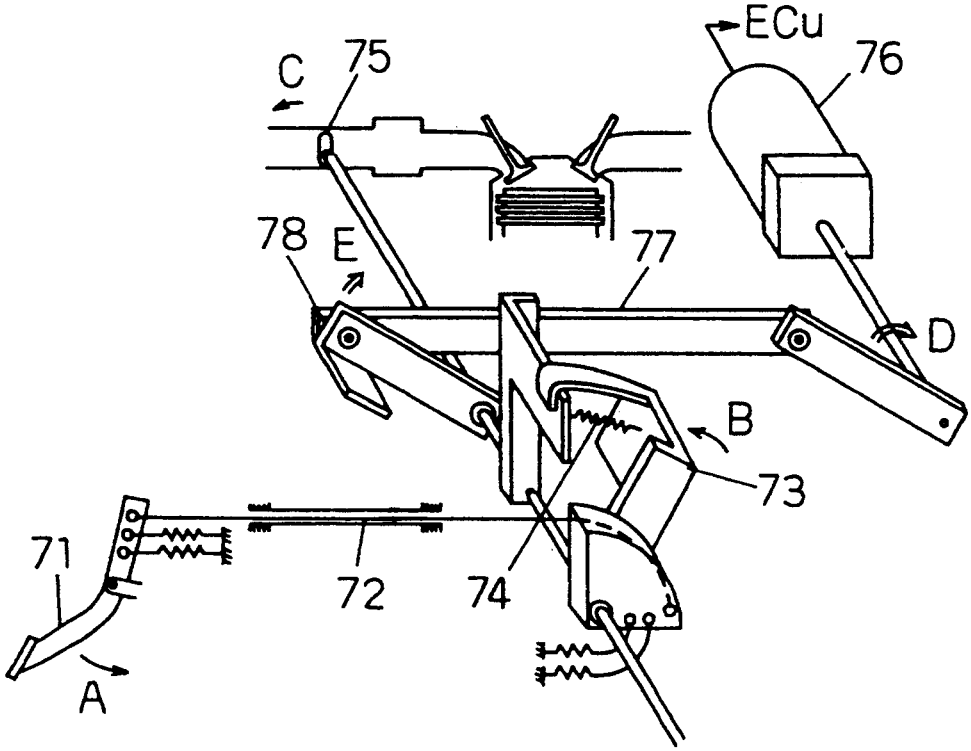
FIG. 7 (PRIOR ART)
FIG. 7 is a perspective view showing the structure of a conventional throttle actuator.
Figure 8:
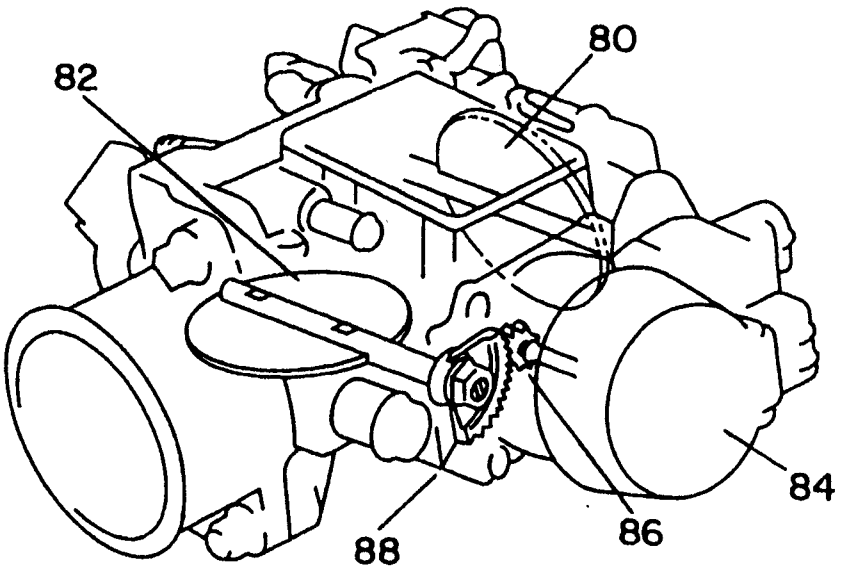
FIG. 8 (PRIOR ART)
FIG. 8 is a perspective view showing the structure of another conventional throttle actuator.

The specification of Model No. 39SHM-32B.
Rate voltage: 12 V
Current: 80 mA/phase
Winding resistance: 150 ohms
Inductance: 150 mH
Step angle: 1.8 degrees
Rotor inertia: 15 g.cm
Retaining torque: 670 g.cm
Angle-retaining force property: 40 g.cm/0.1*
Weight: 180 g The numeral 5 is a throttle valve, which is of a flat and circular type. The left side position of the arrow labelled 90° by the throttle valve 5 in FIG. 4 indicates the "open" position, and the right side position of this arrow labelled 90° indicates the "closed" position. Said valve 5 may be replaced e.g. by an S-shaped valve which only requires a substantially small torque for the rotation purpose. The configuration of said valve can be determined by analyzing the airflow within a intake pipe 14 and calculating a resultant value. FIG. 6 illustrates one example of an S-shaped valve 5s. The upper part is projected to left side and the lower side is projected to right side.

Figure 2:
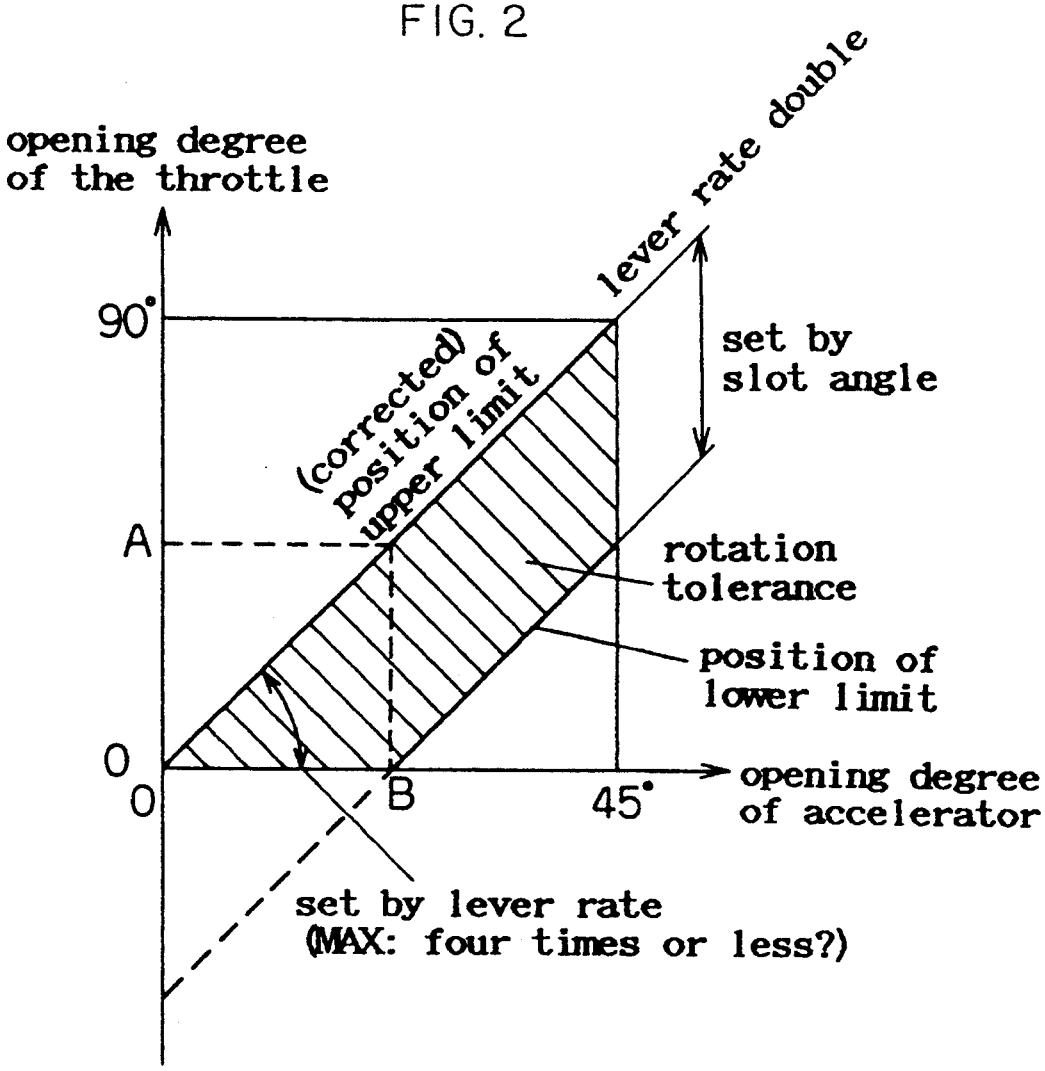
FIG. 2 is a view illustrating the operation of the first embodiment of the throttle actuator in accordance with the present invention.

The numeral 6 designates a throttle valve shaft connected to the rotor of the motor 4 in one body for rotating the throttle valve 5 to move it between open and closed positions. 7 is a first link member of giving a torque to the throttle valve shaft 6 which is secured by welding to the first link member 6. 8 is a pin mounted on the first link member 7, which is destined to be connected with a slot 10, which will be described afterwards, in such a manner that it may be moved within the slot 10. 9 is a second link member of transmitting a power as a turning effort from the accelerator pedal 1 to the throttle valve shaft 6, the second link member 9 being movably supported by a bearing (FIG. 3) and coaxial with respect to the throttle valve shaft 6. The left side position of the arrow labelled 90° by the second link member 9 in FIG. 4 indicates the "open" position, and the right side position of this arrow labelled 90° indicates the "corrected position of the upper limit." The right side position of the arrow labelled 45° by the second link member 9 indicates the "corrected position of the lower limit." 10 is a slot provided on the second link member 9 so that the pin 8 may be received by the slot 10. 11 is a rotating shaft of the second link member 9. The second link member 9 is connected with a lever 17 of the accelerator pedal 1 by a wire 12 so that the former is rotatable in response to the depression amount of the accelerator pedal 1 when it is pressed down. The lever rate of lever 17 is double (45° to 90°). FIG. 2 shows the relation between a throttle actuator and the opening of the accelerator in accordance with the present embodiment.

In this embodiment, the throttle valve is closed when the engine runs idle. Thus, if the throttle valve is in the closed position, the necessary minimum amount of intake gas can be secured by a proper means. As a specific example of said proper means, there is a method of securing the minimum amount of intake gas using a bypass (not shown) provided on an intake pipe.

The lever 17 connected with the accelerator pedal 1 is longer than the radius of gyration of the second link member 9, whereby if the accelerator pedal 1 is pressed down at an angle of 45 degree, the second link member 9 is turned through 90 degree.

The numeral 13 indicates a throttle opening sensing device which acts to detect the rotation angle of the throttle valve shaft 6. In this embodiment, said sensing device 13 is a type corresponding to that of the throttle opening sensing device 3. 14 is a cylindrical intake pipe. 16 is a throttle return spring, which is operative to place the relation between the first link member 7 and second link member 9 in the corrected upper limit position as shown in FIG. 2, if no turning effort from the motor 4 is applied to the throttle valve shaft 6. In other words, the throttle return spring 16 is intended to keep the pin 8 in the left end portion of the slot 10 in the FIG. 1. The throttle return spring 16 is connected with the first link member 7 via a wire. 18 is a motor control device, which is adapted to control the movement of the throttle valve 5 by controlling the motor 4 in response to signals from the accelerator opening sensing device 3 and a control unit 19. 20 is an accelerator return spring. The torque of the motor 4 is weaker than the force of the spring 20.

Figure 3:
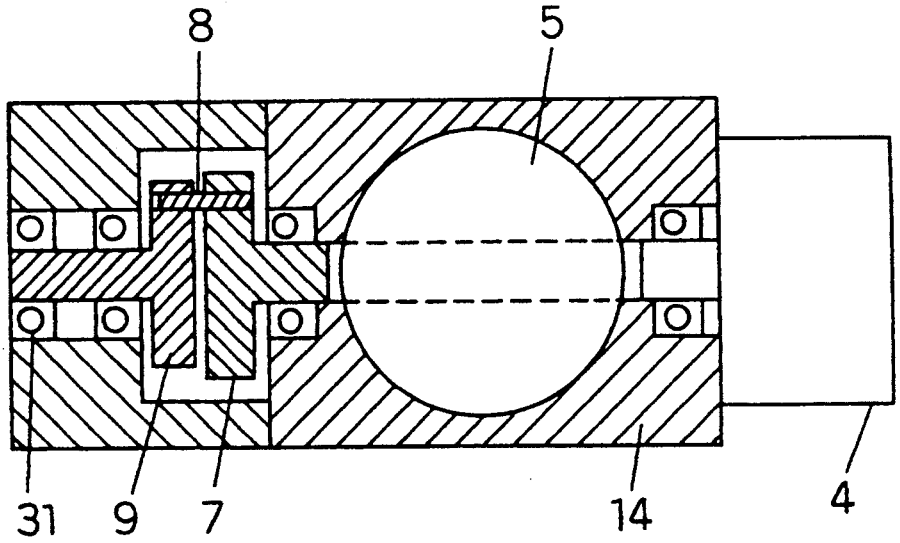
FIG. 3 is a cross sectional view showing the first embodiment structure of the throttle actuator in accordance with the present invention.

FIG. 3 shows a cross sectional view of the assembled throttle actuator in accordance with the present embodiment. 31 is a ball bearing. Elements which are identical to corresponding elements of FIG. 1 have been given the same reference number. Though not in use in this embodiment, a sealing member may be provided in part of the bearing 31.

Next, the operation in the embodiment will be described with reference to the drawings.

FIG. 2 shows the relation between the opening degrees of the throttle valve and accelerator in the throttle actuator of the embodiment.

A shadowed portion as shown in FIG. 2 is an area in which the pin 8 rotates and slot 10 moves, which portion can be controlled by the motor 4.

FIG. 1 is an assumed view of the throttle in the full-closed (shut fully) position. In said position as shown in FIG. 1, the throttle valve shaft 6 receives a force originated from the accelerator return spring 20 to render the throttle valve 5 closed as well as a force originated from the throttle return spring 16 to bring the throttle valve 5 to an opened position. The accelerator return spring 20 is designed to be stronger than the throttle return spring 16 in restoring force, thus resulting in the accelerator return spring 20 exceeding the latter in force, and a force is so exerted on the throttle valve shaft 6 that the throttle valve 5 will be closed. It is a throttle valve shaft 6 of FIG. 1 in such a state that is abutted against a stopper provided on the first link member 7. In this embodiment, the adjustment of the turning effort acting on the throttle valve shaft 6 is based on the accelerator return spring 20 which is stronger than the throttle return spring 16 in restoring force. However, the turning effort acting on the throttle valve shaft 6 may be adjusted by changing the position of connection, provided the both springs are equal to each other in restoring force.

No current is present in the motor 4 when the throttle valve is fully closed as shown in FIG. 1, that is, there is no retaining torque.

As apparent from FIGS. 1, 2, in the present embodiment, there is the fail-safe mechanism. That is, the accelerator 1 is mechanically coupled with the throttle valve 5, and then the automobile can not run away even if the electric system controlling the throttle valve fails. And if such an electrical failure occurs, an idling position is destined to be resumed at least, because the valve is wholly closed.

In order to bring the throttle valve 5 from the full-closed position to the open position gradually, the accelerator pedal 1 is pressed down to open the throttle, to begin with. And then, the accelerator lever 17 will be put in motion to pull the wire 12, which urges the second link member 9 to run counter-clockwise. At the same time, the accelerator opening sensing device 3 determines the degree of opening of the accelerator 1, and supplies a signal to the motor control 18. The consequential rotation of the second link member 9 in a direction to open the throttle valve 5 will invite the throttle return spring 16 to act on the first link member 7 to such an extent that the latter will rotate to bring the throttle valve 5 to the open position. Concurrently therewith, the rotation angle of the throttle valve shaft 6 is detected by the throttle opening sensing device 13, which will transmit a detection signal to the motor control 18. The motor control 18 produces an output for driving the motor 4 from the output of the throttle opening sensing device 13 and a signal from a control unit 19, if necessary, from the output of the accelerator opening sensing device 3. Before the motor 4 is actuated, the initial position of the motor 4 must be identified by the throttle opening sensing device 13. However, if the last position of rotation of the motor 4 has been accurately memorized, no detection of the initial position is necessary.

In such a manner as described above is achieved the control of the throttle valve 5 by the accelerator pedal 1. For example, however, if the accelerator pedal 1 is subjected to a sudden depression, drive wheel tire may be spun. In order to avoid such an occasion, on the basis of the rotary speed and acceleration of the tires, judgment is made on whether or not tires have slipped, and if the result of judgment shows there is a tire slip, the control unit 19 will direct the motor control to close the throttle valve 5 a little more. For the judgment of the tire slip, various known judgment forms may be used.

The motor control 18 acts to actuate the motor 4 in accordance with the command of the control unit 19 in a direction to close the throttle valve 5. That is, once the accelerator pedal 1 is depressed, the throttle valve 5 is controlled by the motor control 18 to determine the allowable range of opening within the shaded area as shown in FIG. 2. The instant embodiment is suitable especially for realization of traction control for tire slip resulting from an over-powered start.

Next, the fail-safe in this embodiment will be described.

The fail-safe is intended here to prevent a car from running away due to the failing of the electric system controlling of the throttle valve 5 by the mechanical coupling between the accelerator 1 and the throttle valve 5, on one hand, and to render the device idle in such an occasion, on the other.

It is most important that the throttle actuator should not get into danger under any circumstances. In the present embodiment, for example, if the IC used in the motor control circuit 18 fails for some reason, the accelerator pedal 1 is returned to the original position and the throttle valve 5 will return to its original position as it is kept fully closed, because the range controlled by the motor 4 is corresponding to the shaded portion only, as shown in FIG. 2. The operation with the fail-safe in action will be described in the following. Assuming that a conductor wire connected between the motor control circuit 18 and the motor 4 has broken down, the motor 4 has no retaining torque as no electric current is present therein and the throttle valve shaft 6 is kept running by the accelerator return spring 20 as in the full-closed position as described above. This is intended to make it possible to close the throttle using the mechanical system only, if the electrical system should fail.

Meanwhile the rotation tolerance in FIG. 2 is dependent on the magnitude (angle) of the slot 10. So, the rotation tolerance can be changed by varying the slot 10 in size.

Figure 9:
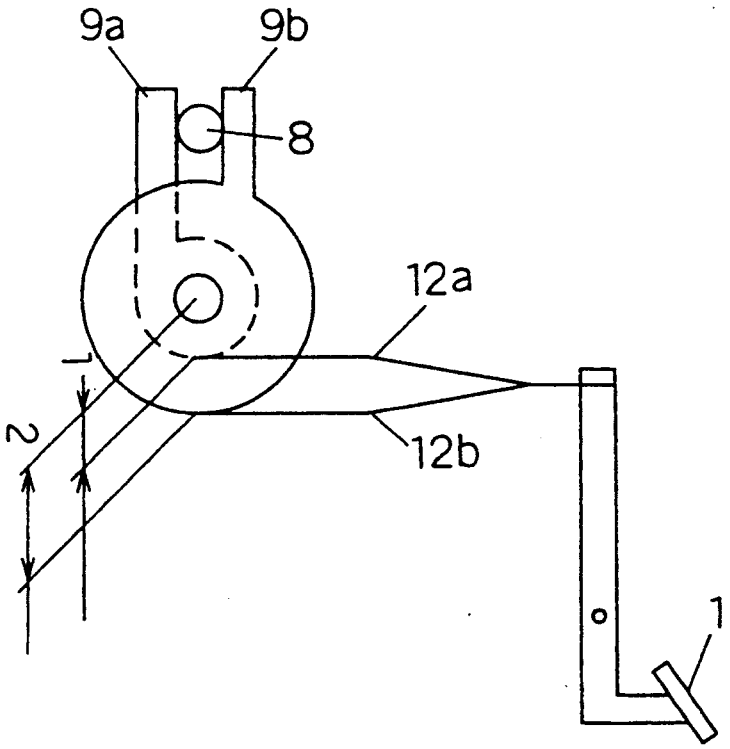
FIG. 9 is a view showing other form of the second link member embodying the present invention.
Figure 10:
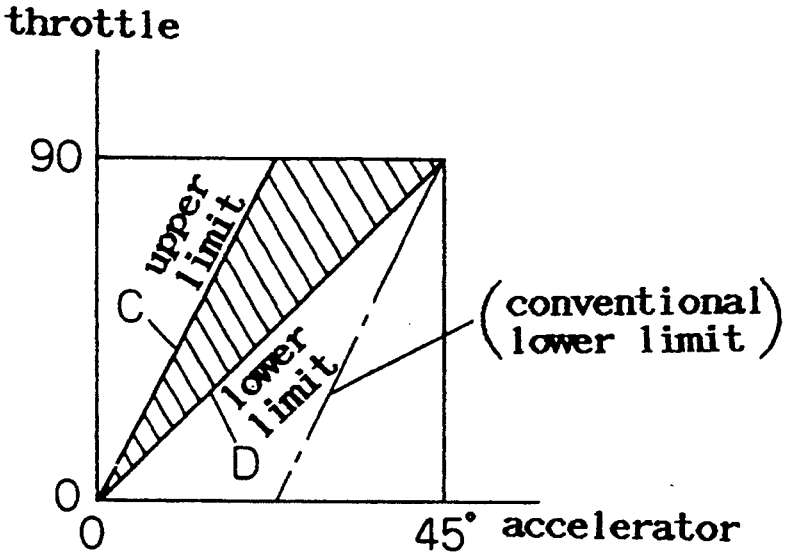
FIG. 10 is a view illustrating a rotation tolerance obtainable by the structure of FIG. 9.
Figure 11:
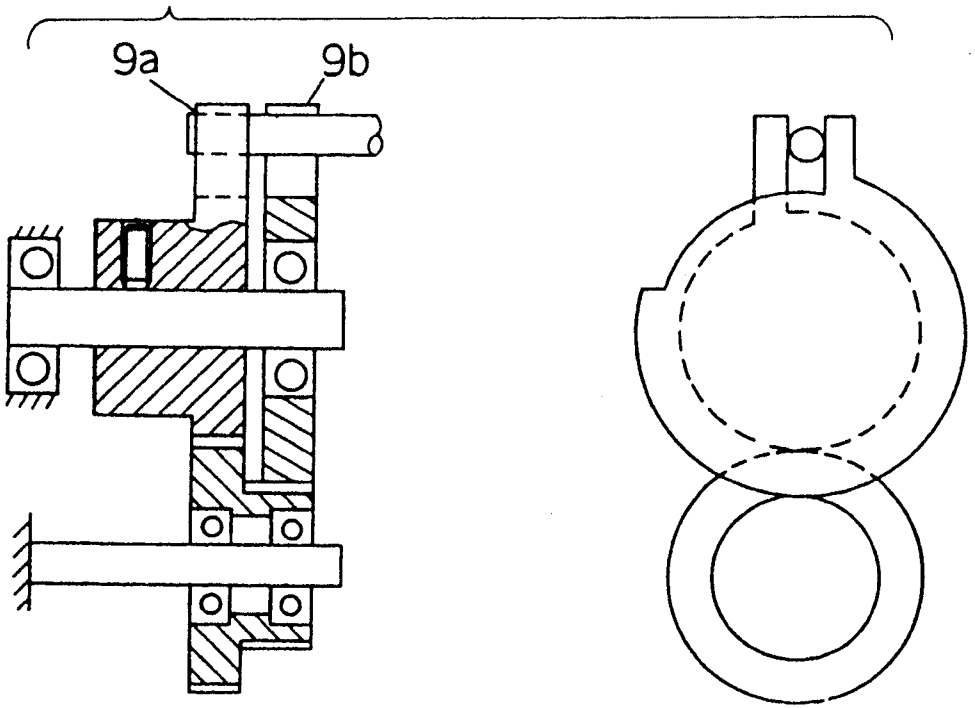
FIG. 11 is a view showing other form of the second link member embodying the present invention.

Means to change the rotation tolerance is illustrated in FIG. 9. FIG. 9 shows the intention of corrected positions of upper and lower limits being separately set up by dividing the second link member 9 into an upper-limit link member **9*a* and a lower-limit link member 9*b*. A corrected tolerance thus obtained is shown in FIG. 10. As shown in FIG. 10, the inclinations of straight lines C, D to determine the corrected positions of upper and lower limits may be changed respectively. The change of these straight lines C, D may be effected by changing a connection part of a wire 12 to the second links 9*a*, 9*b* as shown by FIG. 9. That is, the ratio of a lever between the wire 12 and the second link members 9*a* as well as the wire 12 and the link member 9*b* has only to be changed. This can be done by dividing the wire 12 into an upper-limit wire 12*a* and lower-limit wire 12*b* in order that said divided wires may be tightened by the accelerator lever 17, as shown in FIG. 9. That is, in the case of the range labelled "1" in FIG. 9, the acceleration rate is four times, and in the case of the range labelled "2", the rate is double. In the alternative, as shown in FIG. 11, the wires may be connected only with the upper-limit link member 9*a*, reducing any motion of the upper-limit link member 9*a* with the gear ratio so as to transmit such reduced motion to the lower-limit link member 9*b***. Other speed change means (for example, a belt) may be used.

Figure 12:
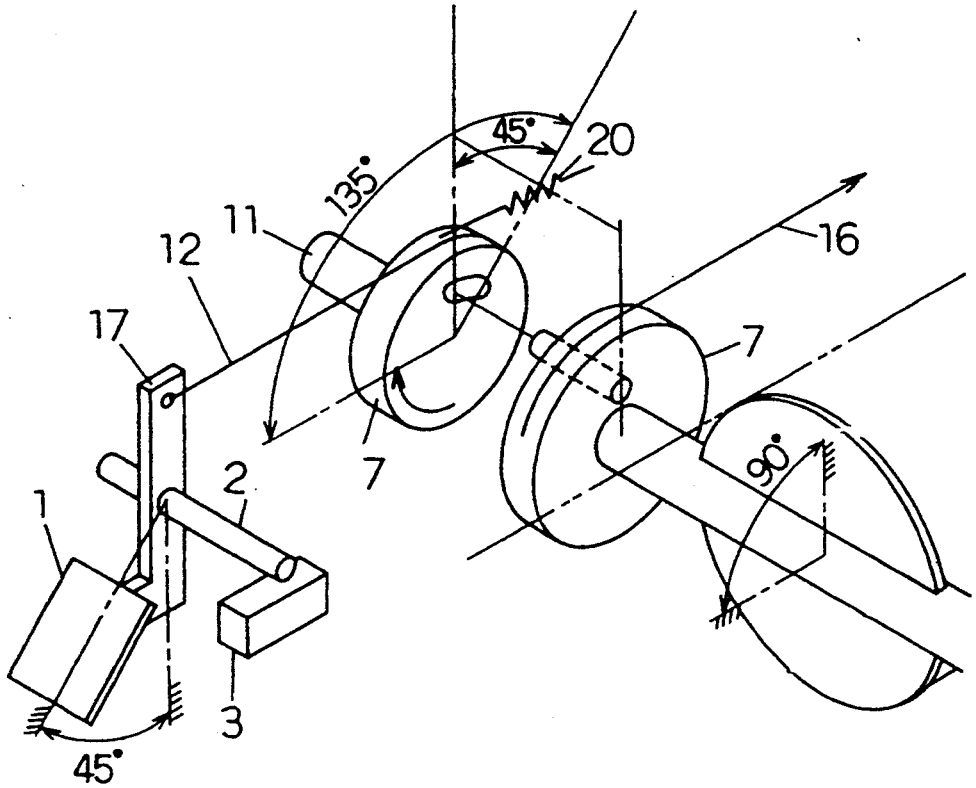
FIG. 12 is a view showing another form of the second link member embodying the present invention.
Figure 13A:
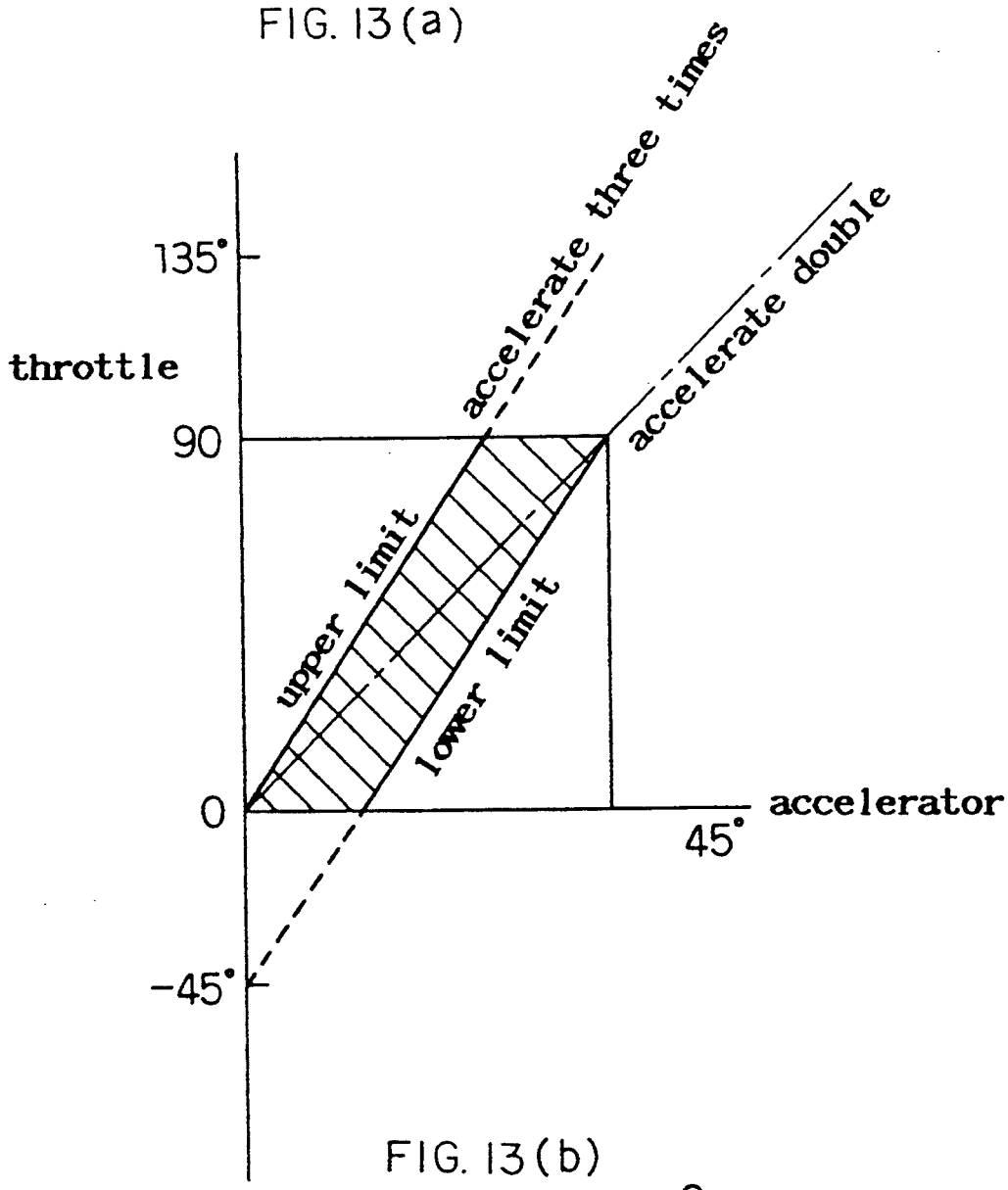
Figure 13B:
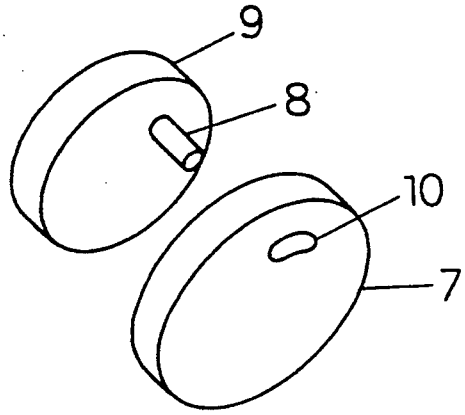

Furthermore, there is another effective method for extending the rotation tolerance. This has been considered in view of the relationship between the throttle opening and the accelerator depression amount (accelerator opening). In the embodiment as described above, the throttle valve 5 is designed to open through 90 degree while the accelerator 1 opens through 45 degree. There is a problem, however, that such a structure may obtain a speed increase ratio only twice bigger at maximum, thus resulting in no further expansion of the corrected position of upper limit. A solution of this problem may be made by setting of the lever ratio of the wire and second link member 7 to be three times bigger, as shown in FIG. 12 The throttle return spring 16 shown in FIG. 12 is weak, i.e., approx. 0. FIG. 13 shows a rotation tolerance as established in FIG. 12.

As apparent from the above-mentioned description, in accordance with the present embodiment, the throttle valve 5 is generally compensate-controlled by the motor 4 under an upper limit due to the depression of the accelerator pedal 1. Therefore, no danger is incidental to accidental failure of the electrical system, and normally, a fine control can be made, thereby to carry out the most efficient traction control.

Further embodiment is described for improving a fail-safe of the present invention.

This specific fail-safe is based on the assumption of a failure of a mechanical unit as newly added by the present invention but having little reliable achievement: even if such a failure happens, a car will never run away with the aid of the mechanical coupling between the accelerator and throttle valve, thereby turning out idle. That is, the mechanical hazard of a motor as a failure of the new mechanical unit is put into consideration. Specifically, there is an intrusion of foreign matters between rotors in the motor. In such a case, it is afraid that the rotor and stator are strongly attached to each other. Thus, it is presumed that if a mechanical force produced when the accelerator 1 is released is applied to the rotor directly connected with the throttle valve 5, the throttle valve 5 will be unable to rotate into the closed position. Therefore, there exists the possibility of the motor being brought to locked position, which has to be addressed. Description will be made of a next embodiment, accordingly.

Meanwhile the first link member 7 can have the slot 10 and to the contrary the second link member 9 can have the pin 8 (shown in FIG. **13(*b*)**), and thereby the engagement can be realized.

(Second Embodiment)

This embodiment has a fail-safe which may be actuated even in the case of the motor being locked for some reason as mentioned above.

Figure 4:
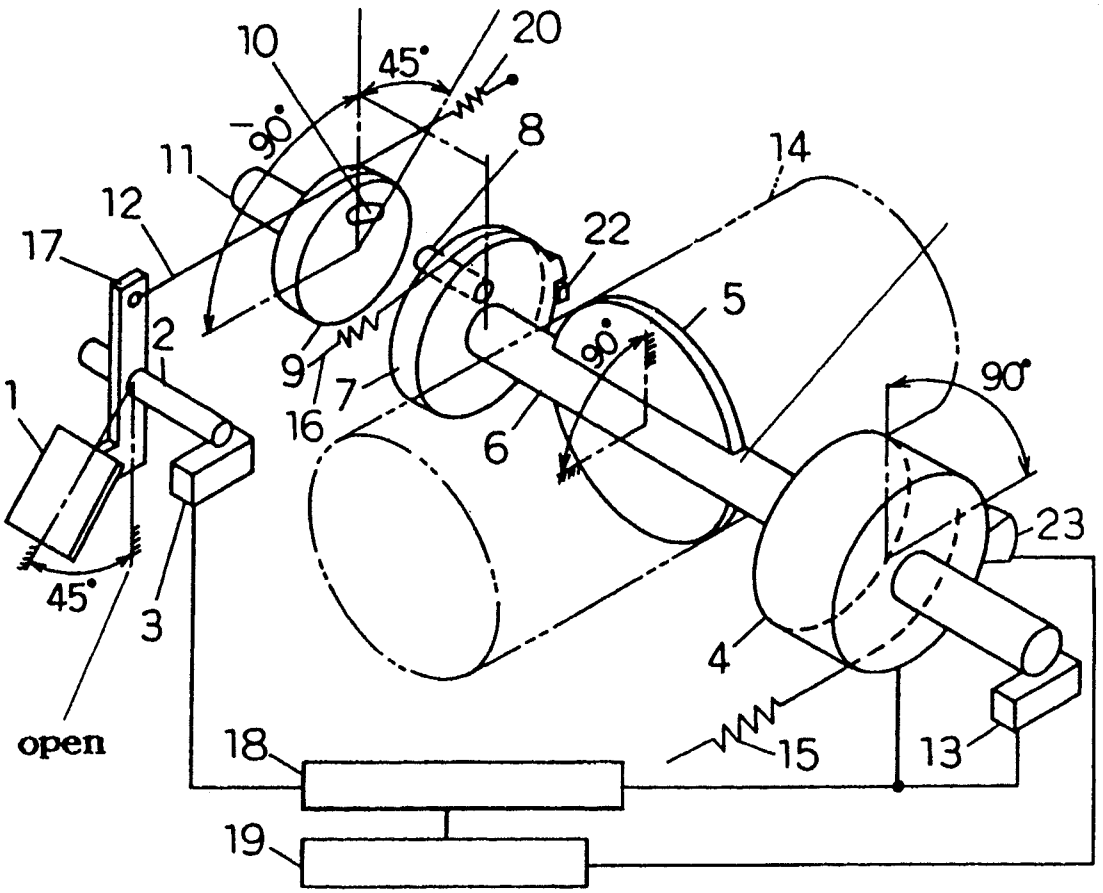
FIG. 4 is a perspective view showing the second embodiment structure of the throttle actuator in accordance with the present invention.

FIG. 4 shows the structure of the present embodiment. This embodiment is different from the first embodiment in that the stator of the motor 4 is fixedly secured to a main body by utilizing the stator return spring 15 and a stator locking means 23. Other components are the same as those of the first embodiment, of which further explanation will be omitted. The stator return spring 15 urges the stator 4 to rotate in a direction to move the throttle valve 5 toward the closed position. The left side of the arrow labelled 90° by the stator 4 indicates the "open" position, and the right side by this arrow indicates the "closed" position. The stator fixing means 23 is a stopper intended to react against a torque given by said stator return spring 15 in resulting to make the stator 4 fixed. This stator locking means 23 is provided with an electromagnetic valve, which can change over from fix to release in response to the direction from the control unit 19. The changeover means from fix to release should not be limited to that of an electromagnetic type, e.g., it may be a combination of a shape-memory alloy and a heating wire.

Figure 14:
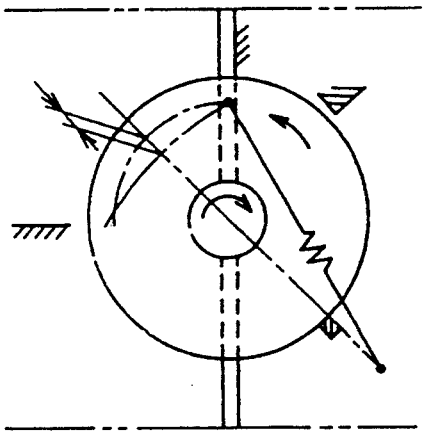
FIGS. 14*a, b* and *c* are views showing by way of example a process for locking stator in the embodiment of the present invention.
Figure 14:
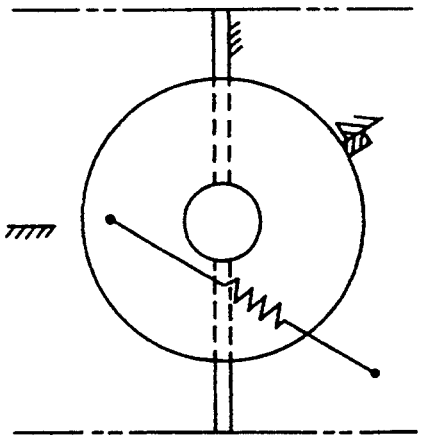
Figure 14:
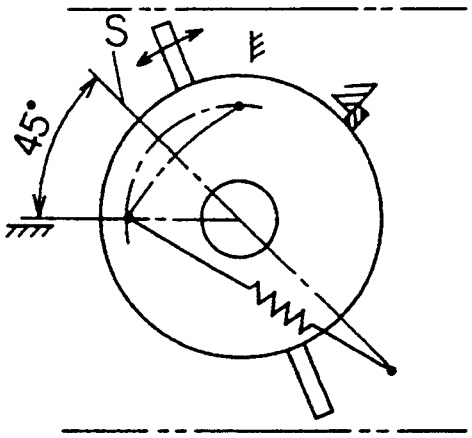

Further the mechanism of fix and release of the stator 4 is arranged as follows. FIG. 14(*a*) indicates the "reset" position, FIG. 14(*b*) indicates the "set" position, and FIG. 14(*c*) indicates the "normal" position. In FIG. 14(*a*), the range indicated by the arrow is the "spring extension amount." The larger ring is the stator and the smaller ring is the rotor. As shown in FIG. 14, the stator has a spring mounted thereon, and normally conducts its acceleration work in the locked condition as shown by FIG. 14(*c*), while in an abnormal case, the spring extends beyond a center line S of FIG. 14(*c*) as shown in FIG. 14(*a*), giving a torque in the opposite direction to that in the normal case, which means that the spring plays the same role as the stator return spring 15. The spring force is such that it can not separate by the mechanical loss throttle force, and it can return by the accelerator return force.

Figure 15B:
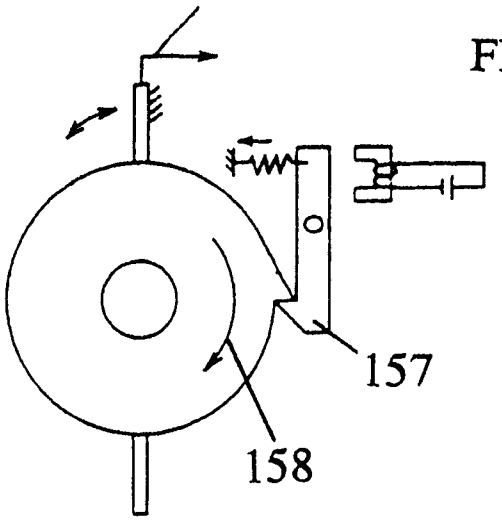
FIGS. 15(*a*) and 15 (*b*) views showing by way of example another process for locking stator in the embodiment of the present invention.
Figure 15A:
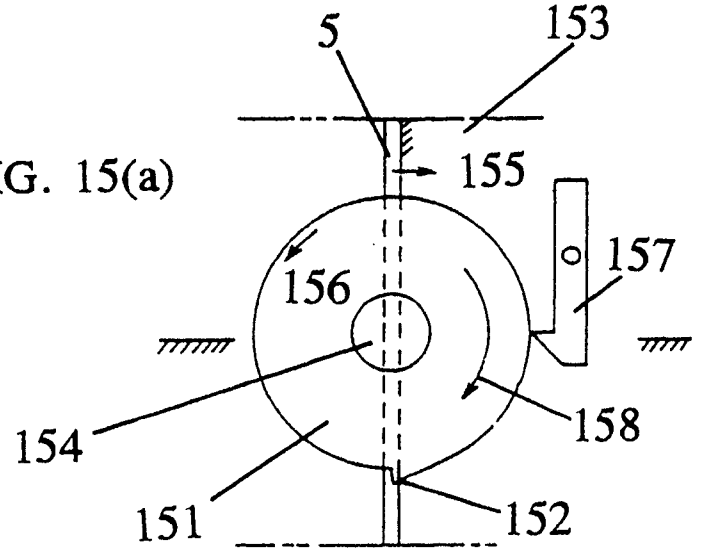

Further as shown in FIG. 15, the stator has a projection 152 provided in part thereof. Normally, as shown in FIGS. 15(*a*) and (*b*) the stator 151 may be brought to a locked condition with the projection 152 in engagement with a claw 157 by using electro-magnetic force, and extraordinarily, the fail-safe functions with the assistance of the stator return spring 15. That is, an electromagnetic means releases the engagement. FIG. 15(*a*) shows the abnormal state and FIG. 15(*b*) shows the normal state. Reference number 153 indicates an intake suction pipe, 154 indicates the rotor, and 155 and 156 indicate initial movement direction arrows. The claw is shown at number 157 (if there is no trigger, the fail-safe action is not produced), and the return force arrow is shown at 158. In this embodiment, the throttle spring force is less than the stator return spring force, which is less than the motor torque.

Figure 16:
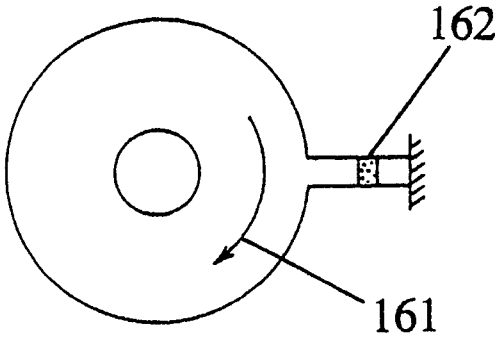
FIG. 16 is a view illustrating a rotation tolerance by the structure of FIG. 15.

Additionally, as shown in FIG. 16, there is a conceivable case where use is made of an air-loaded spring. At the stage of assembly, the stator is locked by a spring constituted by air pressure, and when an abnormality arises, a fail-safe operation is carried out in the form of such a pilot pressure being eliminated from an aperture formed by an explosive means. As shown in FIG. 16, 161 indicates the pilot pressure spring force (pilot pressure at assembly), and 162 indicates the explosive.

In this embodiment, in a normal case, the operation is made in the same manner as in the first embodiment, and so it is also in the electrical system failure. And therefore description will be omitted of the operation in accordance with the embodiment.

The point in this embodiment is a fail-safe procedure which may be followed if the motor is locked because of dust. The following is the description of this point.

The throttle valve 5 which opens with an angle of 45 degree is taken as an example. (A) point as shown by corrugated lines in FIG. 2 illustrates the state of the throttle valve 5 being opened with a angle of 45 degree. When the motor 4 is out of action, said state is represented by a point (A) in the corrected position of upper limit. With the throttle valve 5 squeezed to an ultimate degree by the motor, said state is represented by (B) point of the corrected position of lower limit. Then if the stator 4 and rotor (throttle valve shaft 6) of the motor have been brought to locked positions, the throttle valve 5 is also brought to a locked position accordingly to such an extent that it will not close. In this embodiment, therefore, though the stator 4 of the motor is normally in locked position, but on the occurrence of abnormality, e.g. if the motor has been locked, a fail-safe may be secured by rotating the stator 4 per se of the motor.

Description will be made of the operation with the fail-safe in action to address the abnormality of the motorlock. First, judgment is made by the control unit 19 with reference to outputs from the accelerator opening sensing device 3 and throttle opening sensing device 13 on whether or not the motor is in locked position. If locked, the stator locking means 23 will be ordered to release the stator 4. Upon receipt of the order, the stator locking means 23 will start to release the stator, which will be actuated by the stator return spring 15 to bring the throttle valve 5 to a closed position. Thus, should the motor be locked, the throttle valve 5 will never remain open, thereby to avoid danger such as uncontrollable run of a car.

Now in the embodiment, even if locked, self-running (hereinafter this function is referred to as limp-form function) can be realized.

However, there is still another request as to the fail-safe and a better limp-form function, even if there goes something wrong with the mechanism, such as an electrical system's hazard or motor-lock. The embodiment to realize the request is described as follows.

(Third Embodiment)

Figure 5:
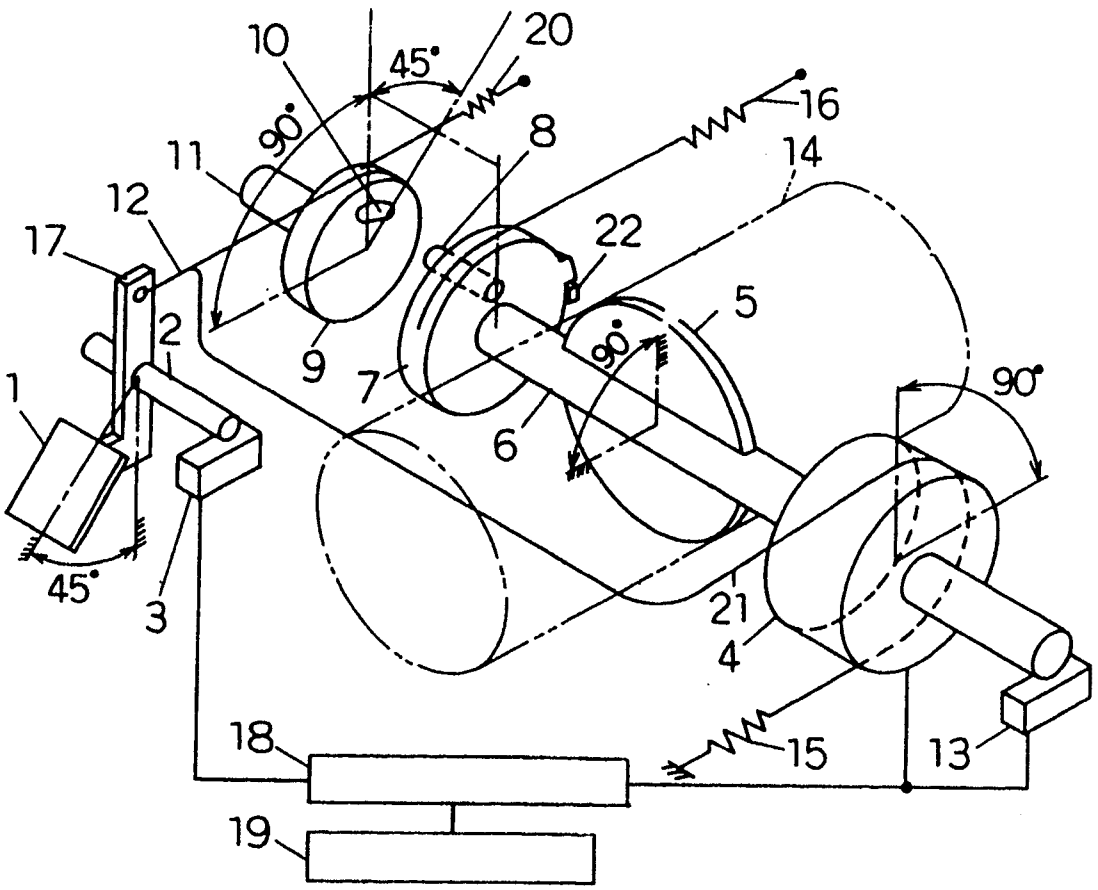
FIG. 5 is a perspective view showing the third embodiment structure of the throttle actuator in accordance with the present invention.

FIG. 5 is a view showing the structure of this embodiment. The instant embodiment is different from the second embodiment in that the former has an additional wire 21. The wire 21 is connected with the accelerator lever 17 and the stator 4 of the motor 4. The wire 21 is connected in parallel with the wire 12 so that the stator 4 and the second link member 9 are rotated at an identical angle. The instant embodiment is characterized in that part of the stator 4 of the motor 4 is rotatably secured by means of the stator return spring 15 and wire 20.

The throttle return spring 16 is mounted in reverse as compared to that of the other embodiment. Other arrangements are much the same as in the second embodiment, and identical elements are given the identical reference numbers.

Next, the present embodiment will be described on the basis of its operation. The relation between the accelerator opening and the throttle opening in this embodiment is the same as that in FIG. 2. In accordance with this embodiment, the throttle valve shaft 6 is based by the throttle return spring 16 to render the throttle valve 5 fully closed, as shown in FIG. 5. The throttle valve shaft 6 is provided with a throttle stopper 22 which serves to prevent the throttle valve shaft 6 from rotating in such a manner that the throttle valve 5 will overstep the full-closed position. The motor 4 carries an exciting current to maintain the rotor of the motor 4.

According to this embodiment, when the throttle 5 is opened, the accelerator pedal 1 is depressed, then the wire 12 is pulled and the second link member 9 is rotated as in the first embodiment. Simultaneously, the wire 21 is also pulled, and the motor 4 will start together with the stator 4. At this time, the stator 4 and the second link member 9 is equal to each other in the angle through which rotation was made. The accelerator opening sensing device 3 acts to detect the accelerator for its degree of opening to convey a signal indicative of the detected result to the motor control 8, which in turn controls the motor 4. In this case, the motor control 8 dispatches a command as to exciting current to be flowed to keep the rotor of the motor 4 locked to the stator 4 of the motor 4, meaning that the motor 4 is operative only to keep the rotor and stator 4 in locked positions. Then, the wires 12 and 21 are pulled, and the throttle valve shaft 6 is rotated to urge the throttle valve 5 to open, with the result that the number of rotation of the engine will be increased. In contract, if the accelerator 1 is released, the throttle valve shaft 6 is urged by a torque given by the throttle return spring 16 to rotate so that the throttle valve 5 will start closing and arrive at the full-closed position in due course.

When the traction control is performed in the normal acceleration process, the control of the throttle valve 5 can be achieved within the range of the shaped portion as shown in FIG. 2. The control process of the throttle valve 5 will no longer be described because it is the same as that of the first embodiment.

As regards the fail-safe of the present embodiment, should the motor be locked, throttle valve 5 can be led to the full-closed position since the stator 4 is so connected with the stator locking spring 15 that the stator 4 per se is ready to rotate.

Further since the wires 12 and 21 are pulled at the same time with the stator 4 per se in the movable condition, even if the motor is locked, the limp-form function may be achieved.

In accordance with the instant embodiment, should the motor be locked, the throttle valve may be brought to a full-closed position. Therefore, it is possible to provide safer throttle actuator.

If the stator 4 of the motor 4 and the second link member 9 are formed integral with each other, a single wire will do.

In this case, the second link member 9 may be placed at the motor side relative to the intake pipe 14.

(Fourth Embodiment)

Next, a fourth embodiment of the present invention will be described. This embodiment is intended to enable not only the traction control but also the autocruise function as well as a high degree of control in the start of a car.

Figure 17:
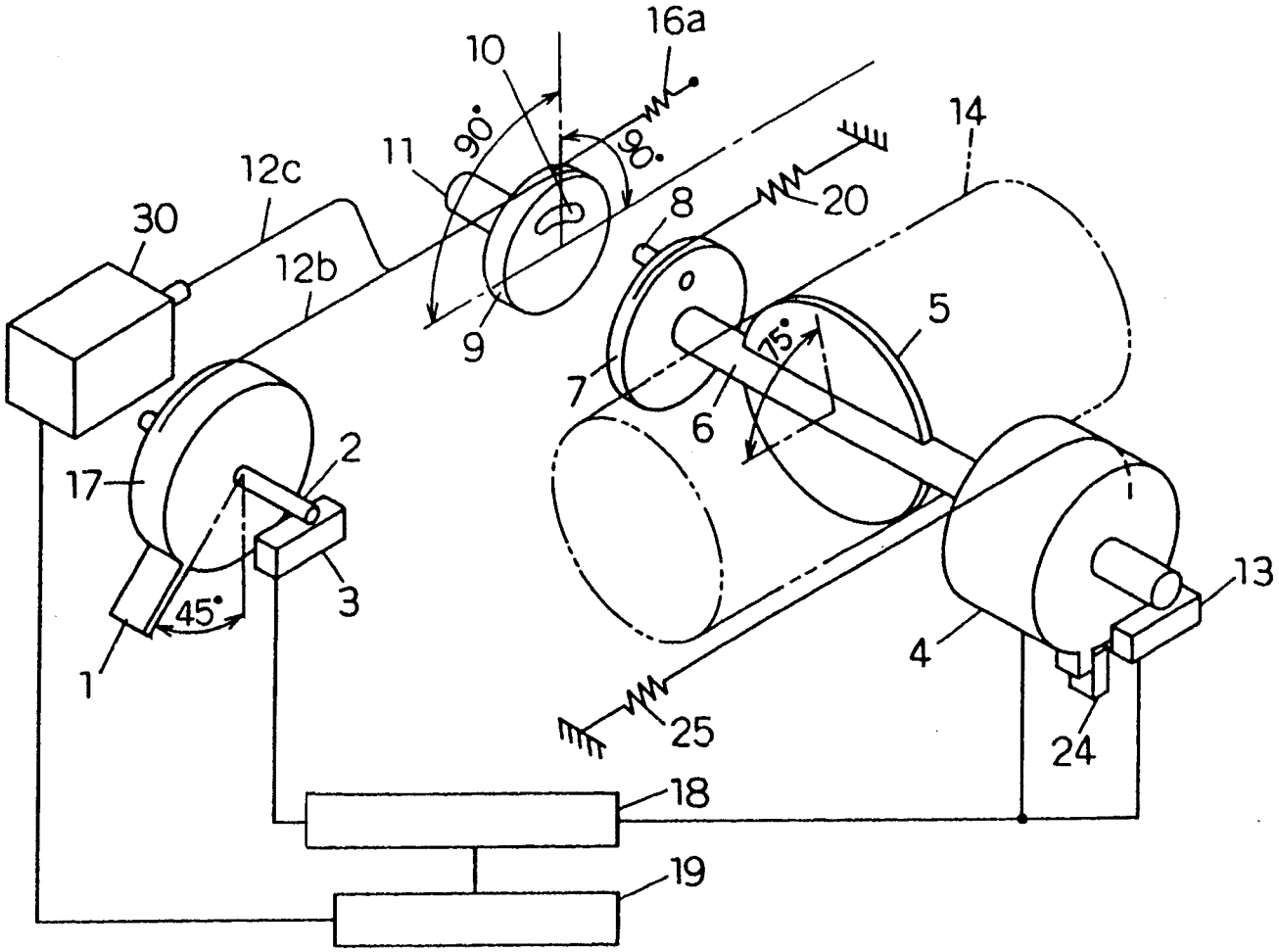
FIG. 17 is a perspective view showing the structure of the fourth embodiment of the throttle actuator in accordance with the present invention.

FIG. 17 shows a structure of the embodiment. In this drawing, elements identical to corresponding elements of the above embodiment have been given the same reference numbers. The present embodiment is characterized by the actuator 30 for autocruise and long slot 10 for correction. The long slot 10 has 90 degree angle and therefore the rotation torelance is shown as in FIG. 18.

Figure 18:
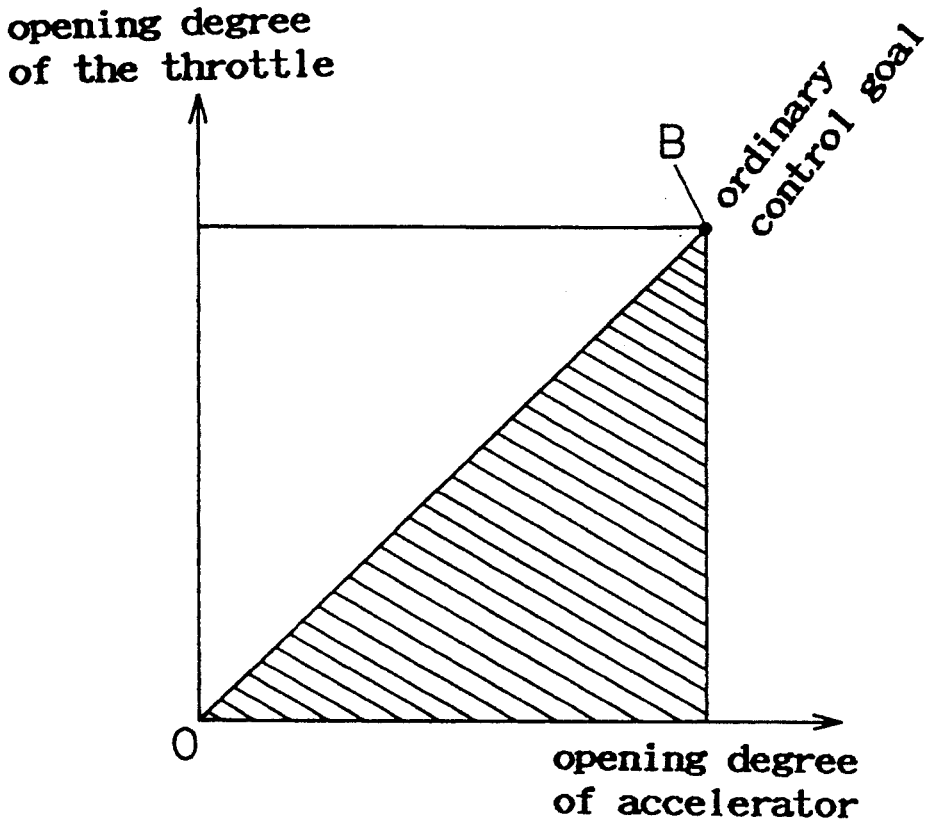
FIG. 18 is a view illustrating the operation of the fourth embodiment.

The actuator 30 for autocruise is connected with the second link member 9 through a wire 12*c*. The actuator 30 for autocruise can be placed in two positions, such as ON/OFF for autocruise control by e.g. electro-magnet; if the actuator 30 is turned OFF for autocruise, is moved on the ordinary control goal as shown in FIG. 18, while if ON, the autocruise actuator 30 will act to pull the wire 12*c* to open the accelerator 1 to the B point as shown in FIG. 18.

Under such conditions, the slot opening is controlled by the motor control to realize the speed control and therefore the autocruise control is executed.

And in the embodiment the restoring force of the accelerator return spring 16*a* is set to be larger than those of the stator pressing spring 25. In such a structure, if the stator 4 of the motor is put in a locked position, when the accelerator pedal 1 is released, the throttle will return to the full-closed position by the aid of a restoring force of the accelerator return spring 16*a*.

The relation between the respective spring restoring forces and the motor torque is mentioned as under.

Throttle return spring<motor torque<stator pressing spring<accelerator return spring The springs so related with each other as described above can assuredly and promptly conduct a fail-safe operation when the motor is locked.

Next, description will be made of the operation of the instant embodiment.

The description will begin as to the operation in a normal state. In the normal state, a motor drive can be made in a rotation tolerance region as shown in FIG. 18, thus enabling the traction control. When the autocruise, operator turns on a switch for "running at constant speed", followed by the transmission from the control unit 19 to an actuator for autocruise 30 of informations that the autocruising mode is turned ON so as to direct the actuator 30 to pull the wire 12*c*. The wire 12*c* is pulled by a distance so as to come to the position B of FIG. 18.

In accordance with the present embodiment, the long slot 10 for correction has 90 degree and the rotation tolerance may be changed as shown in FIG. 18, whereby the engine control such as autocruise control idling control, etc., can be performed by the control of the throttle valve.

The so-called momentary speed drop which may occur at the start of autocruising operation can be avoided by the use of the throttle actuator in accordance with the present embodiment.

Referring to the function of the autocuising actuator, the throttle wire was conventionally controlled in a linear manner. As aforementioned, in this embodiment, two-staged motion of ON/OFF may be used.

In accordance with the present invention, the optimum rotation tolerance for the first and second link members may be established by arranging the configurations of the pin and slot, and the motor is locked by springs, to ensure that the throttle will be subjected to fine and very efficient control such as autocruising traction control, and idling control. Should the electrical system fails or the motor be locked due to dust, the throttle actuator in accordance with the present invention is designed to act for safety at all times.

What is claimed is:

1. A throttle actuator comprising:

an intake pipe of feeding vaporized fuel to an engine, a throttle valve arranged in said intake pipe and adapted to rotatably be driven to open and closed positions, a throttle valve shaft supporting said throttle valve and rotatably mounted on a portion of a vehicle, a motor for supplying a torque to said throttle valve shaft, a first link member secured to and transmitting a torque to said throttle valve shaft, a second link member having two stopper parts engageable with said first link member and movable in response to an accelerator depression amount, a motor control means for controlling said motor, an accelerator returning means of always supplying a torque to said throttle valve shaft so as to close the throttle valve, and said first link member being coupled to said second link member in a manner that said first link member is allowed to rotate between said two stopper parts, and said motor control means driving said motor to control said throttle valve shaft so as to make said first link member rotate between said two stopper parts.

2. A throttle actuator in accordance with claim 1, further comprising:

an accelerator opening sensing device for detecting a moving amount of an accelerator, and said motor control means driving said motor in response to an output of said accelerator opening sensing device.

3. A throttle actuator in accordance with claim 1, wherein:

said two stopper parts are both edges of a slot and said first link member is coupled to said second link member with a pin fixed to the first link member and inserted to said slot.

4. A throttle actuator in accordance with claim 1, further comprising:

a stator return spring connected with a stator of the motor for rotating said stator to bring the throttle valve to a full-closed position if abnormality arises, and a stator locking means for normally locating said stator in a locked position, while releasing said stator in case of emergency, and said motor control means issuing a command to said stator locking means as to the stator to be released into rotation, when the motor control means judged that the motor is in the lock.

5. A throttle actuator in accordance with claim further comprising:

a stator return spring connected with a stator of the motor for rotating said stator to bring the throttle valve to the full-closed position, and a wire movable dependent on the accelerator depression amount and being connected with the stator of the motor.

6. A throttle actuator in accordance with claim 1, wherein:

said second link member is provided with an upper-limit link member and a lower-limit link member, said upper- and lower-limit link members are connected through a wire directly or indirectly to an accelerator pedal respectively so that they may separately rotate in response to the accelerator pedal depression amount.

7. A throttle actuator in accordance with claim 6, wherein:

a torque transmission means for transmitting rotations of the upper- and lower-limit link members, a wire coming from the accelerator pedal is connected with either upper-limit link member or lower-limit link member, and link member not connected with the wire is supplied with a torque from the other link member through said torque transmission means.

8. A throttle actuator in accordance with claim 1, wherein:

said motor takes a form of a stepping motor.

9. A throttle actuator in accordance with claim 1, wherein:

said throttle valve takes a form of a S-shaped valve.

10. A throttle actuator in accordance with claim 1, further comprising:

a cruise control device, which produces an output to control the motor when a constant speed run is needed.

11. A throttle actuator comprising:

an intake pipe of feeding vaporized fuel to an engine, a throttle valve arranged in said intake pipe and adapted to rotatably be driven to open and closed positions, a throttle valve shaft supporting said throttle valve and rotatably mounted on a portion of a vehicle, a motor for supplying a torque to said throttle valve shaft, a first link member secured to and transmitting a torque to said throttle valve shaft, and having two stopper parts, a second link member engageable with said first link member by said two stopper parts and movable in response to an accelerator depression amount, a motor control means for controlling said motor, an accelerator returning means of always supplying a torque to said throttle valve shaft so as to close the throttle valve, and said first link member being coupled to said second link member in a manner that said first link member is allowed to rotate by said two stopper parts, and said motor control means driving said motor to control said throttle valve shaft so as to make said first link member rotate by said two stopper parts.

12. A throttle actuator in accordance with claim 11, further comprising:

an accelerator opening sensing device for detecting an moving amount of an accelerator, and said motor control means driving said motor in response to an output of said accelerator opening sensing device.

13. A throttle actuator in accordance with claim 11, wherein:

said two stopper parts are both edges of a slot and said first link member is coupled to said second link member with a pin fixed to the second link member and inserted to said slot.

14. A throttle actuator in accordance with claim 11, further comprising:

a stator return spring connected with a stator of the motor for rotating said stator to bring the throttle valve to a full-closed position if abnormality arises, and a stator locking means for normally locating said stator in a locked position, while releasing said stator in case of emergency, and said motor control means issuing a command to said stator locking means as to the stator to be released into rotation, when the motor control means judged that the motor is in the lock.

15. A throttle actuator in accordance with claim 11, further comprising:

a stator return spring connected with a stator of the motor for rotating said stator to bring the throttle valve to the full-closed position, and a wire movable dependent on the accelerator depression amount and being connected with the stator of the motor.

16. A throttle actuator in accordance with claim 11, wherein:

said second link member is provided with an upper-limit link member and a lower-limit link member, said upper- and lower-limit link members are connected through a wire directly or indirectly to an accelerator pedal respectively so that they may separately rotate in response to the accelerator pedal depression amount.

17. A throttle actuator in accordance with claim 16, wherein:

a torque transmission means for transmitting rotations of the upper- and lower-limit link members, a wire coming from the accelerator pedal is connected with either upper-limit link member or lower-limit link member, and link member not connected with the wire is supplied with a torque from the other link member through said torque transmission means.

18. A throttle actuator in accordance with claim 11, wherein:

said motor takes a form of a stepping motor.

19. A throttle actuator in accordance with claim 11, wherein:

said throttle valve takes a form of a S-shaped valve.

20. A throttle actuator in accordance with claim 11, further comprising:

a cruise control device, which produces an output to control the motor when a constant speed run is needed.

* * * * *